US006161728A

United States Patent [19]

Dark

[11] Patent Number: 6,161,728

[45] Date of Patent: Dec. 19, 2000

[54] BARRIER PIERCING DISPENSING CLOSURE

[76] Inventor: Richard C. G. Dark, 2248 Gum Tree La., Fallbrook, Calif. 92028

[21] Appl. No.: 09/376,521

[22] Filed: Aug. 18, 1999

[51] Int. Cl.[7] ..... B67D 5/00

[52] U.S. Cl. ..... 222/83; 222/153.07; 222/530; 222/533

[58] Field of Search ..... 222/83, 83.5, 88, 222/81, 89, 533, 534, 153.07, 568, 570, 530

[56] References Cited

U.S. PATENT DOCUMENTS 4,216,880 8/1980 Drelichowski ..... 222/83
4,440,327 4/1984 Dark ..... 222/530
4,779,764 10/1988 Debetencourt ..... 222/153.07 X
5,392,968 2/1995 Dark ..... 222/529

*Primary Examiner*—Kevin Shaver
*Assistant Examiner*—Thach H Bui
*Attorney, Agent, or Firm*—Ronald M. Goldman

[57] ABSTRACT

A dispensing closure contains a foil piercing system. By opening the closure (2), the foil piercing system (6) automatically perforates the foil seal (9) to the bottle on which the closure is mounted, releasing the bottled materials to flow through the closure's dispensing orifice. The closure also includes a tamper evident strip (7) that, unless removed, inhibits opening the closure.

16 Claims, 1 Drawing Sheet

BARRIER PIERCING DISPENSING CLOSURE

FIELD OF THE INVENTION

This invention relates to dispensing closures, and, more particularly, to resealable dispensing closures containing a pivotable pouring spout for use with foil sealed bottles. The invention provides a dispensing closure with a foil piercing system, whereby opening the closure also opens the foil seal on the bottle.

BACKGROUND

In the bottling industry where glass or plastic bottles are used to package liquids and other flowable matter, it is common practice to seal the bottle neck with a barrier, typically, a metal foil. That seal serves two purposes: First, it serves as a tamper evident feature. The presence of a tear in the seal or the absence of the seal, entirely, alerts the purchaser that the security of the contents has been jeopardized, evidence of the possibility that the contents might have been tampered with. Secondly, the seal isolates the contents of the container from the atmosphere and vice-versa. That prevents atmospheric contamination that may adversely affect the quality of the contents. Conversely, it also prevents escape of volatile ingredients to the atmosphere, which also may lower product quality. In the latter sense, a foil seal also acts as a flavor barrier. As example, flavored toothpaste requires that the toothpaste maintain its freshness over time. By isolating the toothpaste from the atmosphere, the flavoring ingredient cannot escape, thereby increasing the toothpaste's shelf life.

Such foil sealed bottles are also fitted with a closure, typically a cap, that is screwed into place on the neck over the seal. To access the contents following purchase of the bottled product, the cap is first removed; the seal is torn off or punctured; and the desired quantity of the ingredient is dispensed. The cap is then screwed back into place on the bottle so that any remaining content may be safely stored for later use.

Although a screw-on type cap is suitable for such application, the newer class of dispensing closures offers some advantage. For one, a dispensing closure is not ordinarily removed from the container, hence, cannot be dropped on the floor and become contaminated. It can be opened and closed with one hand while holding the bottle, a convenience in some applications. The dispensing closure can be permanently attached to the bottle in any conventional way, such as with an adhesive, bonding material, and, with plastic bottles, by fusion or welding.

Further, a foil sealed beverage bottle containing a standard threaded cap requires one to remove the cap and then tear off the foil before being able to drink the beverage directly from the bottle. In doing so, the thread on the bottle's neck comes into direct contact with the drinker's lips. One often finds that some of the beverage dribbles around the threads on the bottle, and could drip onto and soil the drinker's clothing. As an advantage, such cannot occur with bottles that instead use a cap with a dispensing spout.

If an existing dispensing closure were to be used on such a foil sealed bottle it should necessarily contain an internal screw-thread, permitting the closure to be screwed down onto the bottle's neck, which is accomplished at the bottler. Following the product purchase, the dispensing closure must be removed initially to permit the foil seal to be removed, and then, like the cap, may be screwed back into place on the bottle's neck. It is recognized that the extra steps taken are a slight inconvenience. However slight that inconvenience may be, it detracts from the advantages offered by the dispensing closure.

One successful dispensing closure is described in my prior U.S. Pat. No. 5,392,968 granted Feb. 28, 1995, entitled Dispensing Closure and Method and an earlier version is also described in my prior U.S. Pat. No. 4,440,327, granted Apr. 3, 1984, the content of which patents are incorporated herein by reference.

The Dark '968 patent shows a closure in which a spout is pivotally connected to the closure base by a living hinge formed in the base. The spout is also connected to an invertible diaphragm system connected to the closure base. The spout may be pivoted between an upright position, opening the closure, and a horizontal position, closing the closure, swiveling and flexing the diaphragm during pivoting. An entry end to the spout, located on the underside of the closure, contains a fluid seal. That seal compresses against a seal wall, when the spout is in the horizontal closed position. An advantage to the construction described in the Dark patent is that the closure may be molded in one piece, avoiding the need to assemble separate pieces to form the closure. Spouted closures incorporating the construction described in the Dark patents have previously been marketed by the Allied Mold and Die Company, of Fontana, Calif.

Therefore, an object of the present invention is to invest a dispensing closure structure with the ability to pierce and open a bottle's foil seal automatically upon opening the dispensing closure.

A further object of the invention is to eliminate the inconvenience of removing a dispensing closure from a foil sealed bottle in order to access and open the bottle's foil seal prior to dispensing any ingredients confined in the bottle through the dispensing closure.

A still further object of the invention is to incorporate a cutter within a spouted dispensing closure of the kind illustrated in the aforementioned Dark patents wherein the cutter is able to pierce the barrier seal on the bottle to which the closure is mounted, when the spout is pivoted to the open position.

An additional object of the invention is to inhibit opening of a dispensing closure initially without first requiring the removal of a protective strip present to provide visual evidence that the closure has not previously been opened, a tamper evident feature.

And, an ancillary object of my invention is to provide a tamper evident barrier piercing dispensing closure that is molded from one-piece of plastic material to form a unitary integral assembly.

SUMMARY OF THE INVENTION

In accordance with the foregoing objects, a resealable dispensing closure intended for use with a foil sealed bottle contains a foil piercing system concealed within the closure body. When in place on a foil sealed bottle, opening the dispensing closure simultaneously activates the foil piercing system, which perforates the foil, allowing the bottled materials to flow through the closure's dispensing orifice.

In one embodiment the closure is of the type containing a pivotable spout and diaphragm, in which the spout is pivoted clockwise to an upward position to open the closure. The foil piercing system comprises a pair of extending knives, one located on either side of the underside of the spout. Each of those knives contains a pointed end corner. The piercing system is mechanically coupled to the spout for pivotal movement therewith, whereby pivoting the spout up to the open position, pivots the knives down. With the closure mounted atop a foil sealed bottle, the knives press into the bottle's underlying foil seal to pierce through the seal, when the knives are pivoted downward.

In accordance with the tamper evident aspect to the invention, the surface of the closure base contains a well or depression. The spout pivots into that depression when the spout is closed, which is the initial position for the spout when the closure is first mounted atop a bottle. The width of the depression is sufficiently narrow to prevent the sides of the spout from being gripped with ones fingers, and, hence, the spout can be pivoted up from the depression by pushing up on the spout's distal end. A rigid frangible strip extends from the closure base to block access to the spouts distal end, unless the frangible strip is first removed. Removal of the frangible strip provides notice of tampering.

The foregoing and additional objects and advantages of the invention together with the structure characteristic thereof, which was only briefly summarized in the foregoing passages, becomes more apparent to those skilled in the art upon reading the detailed description of a preferred embodiment of the invention, which follows in this specification, taken together with the illustration thereof presented in the accompanying drawings.

DETAILED DESCRIPTION OF THE PREFERRED EMBODIMENTS

Figure 1:
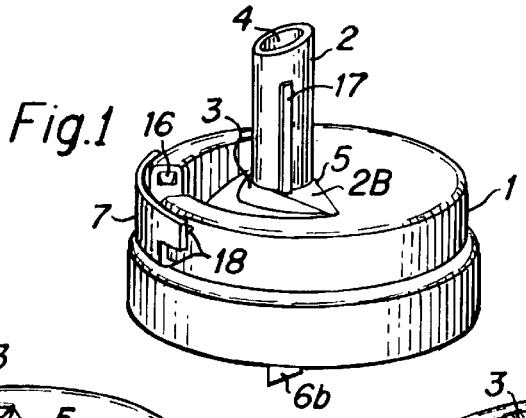
FIG. 1 illustrates an embodiment of the invention as it appears when removed from the mold.
Figure 2:
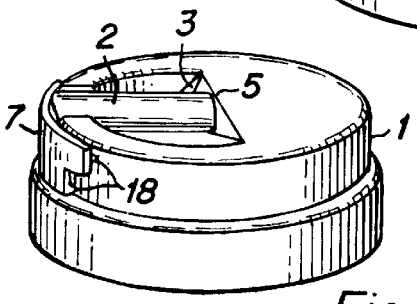
FIG. 2 illustrates the embodiment of FIG. 1 in the initial closed condition as ready for installation to a bottle.

Reference is made to FIG. 1, showing a top perspective view of a preferred embodiment of my new dispensing closure following molding and to FIG. 2, which illustrates that closure as completed for delivery to the bottler. Preferably being molded in one piece of plastic material in which all of the elements are integrally formed together in the closure body 1, in FIG. 1 the closure is illustrated in an open condition, that is, with its rigid spout 2 upstanding, which is the condition in which the closure appears as withdrawn from the injection mold. FIG. 2 illustrates the closure as it appears in the closed condition with the spout down.

The closure body or, as variously termed, base 1 is essentially hollow. The stepped cylindrical walls of the closure base define an open hollow region on the underside accessible from below. Those walls contain a molded screw thread to enable the closure to be screwed into place atop the neck of a screw type bottle and contains additional elements which are discussed hereafter in connection with the underside views presented in the additional figures.

Referring to FIG. 1, Spout 2 is pivotally connected at a lower end portion to the upper surface of body 1 by a living hinge 5 that serves as a pivot. The living hinge extends in a straight line along one side of the spout, essentially tangent to the spout's cylindrical surface. The closure includes a diaphragm 3, a tear-off tamper evident strip 7, and a barrier piercing device or, as variously termed, knife 6, only a portion of which is visible in the figure.

Spout 2 extends through to the underside of the upper surface of the body and opens into the hollow. The entry to spout passage 4 is located on the underside of the closure body within the hollow region, not visible in this view. Apart from the living hinge, the spout is connected to a flexible and/or deformable diaphragm 3.

The preferred diaphragm system structure and the internal valving employed in this cap is that described and illustrated in Dark U.S. Pat. No. 5,392,968 granted Feb. 28, 1995, entitled Dispensing Closure and Method, which is incorporated herein in its entirety by reference. Briefly, as described in the '968 Dark patent, diaphragm 3 contains a top flexible portion and a lower flexible portion. As in the closure of the '968 Dark patent, pivotable movement of spout 2 is permitted due to the flexure of diaphragm 3, which is attached to both the spout and to the support surfaces of the more rigid cap base. When the spout is pivoted down to the closed position, as illustrated in the perspective of FIG. 2, the foot end of the spout carries the diaphragm downward as well, and the diaphragm flexes and bends to permit the spout to be pivoted down into the well formed in the upper surface. The diaphragm's flexure permits the spout to be pivoted and maintains the continuity of the closure's surfaces in the face of that spout movement. The interested reader is invited to consider the more detailed description of the folding and flexing of the diaphragm during pivoting of the spout presented in the foregoing Dark patent.

A rigid plastic portion 2B is integrally formed with the lower end of spout 2 and extends laterally to each side of the spout, only a portion of which is visible in FIG. 1, and is flexurally joined to diaphragm 3. That portion, which is relatively rigid and, may be referred to or characterized as "side wings" or flanges integral to the lower end of the spout or. Alternatively, portion 2B may be characterized as a third portion or upper portion of the diaphragm 3. Since the foregoing comprise an integral assembly of cooperating elements, the characterization of that rigid portion is unimportant. It serves to strengthen the spout and provides a region on which the barrier piercing members 6*a* and 6*b*, such as illustrated in the bottom view of FIG. 5, later herein more fully described, can be formed and supported, and the portion pivots with spout 2.

It may be briefly noted that in referring herein to the lower end of the spout, it should be realized that reference is being made to the lower end thereof on the upper surface of closure body 1. When reference is made to the bottom end of spout 2, what is referred to is the spout entry end on the underside of closure body 1 as it appears in FIG. 7, as example.

Figure 3:
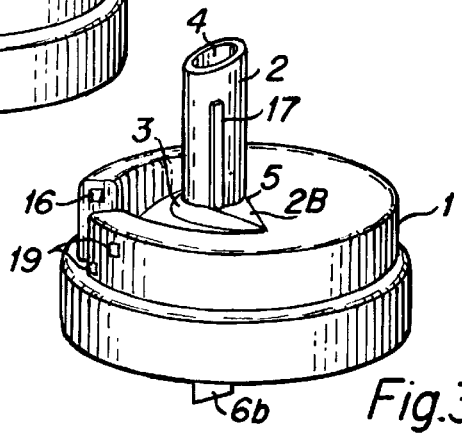
FIG. 3 illustrates the embodiment of FIG. 1 in the open condition ready to dispense ingredients from a bottle.
Figure 5:
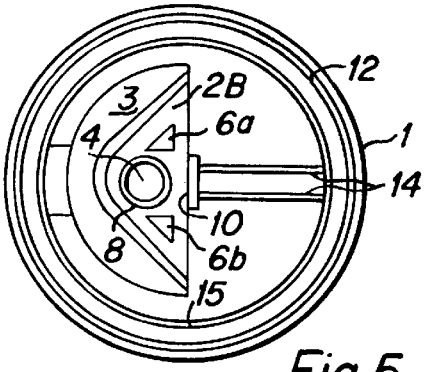
FIG. 5 is a bottom plan view of the dispensing closure in the open condition as presented in FIG. 3.

As shown in the bottom view of the closed spout presented in open condition in FIG. 5 the foil piercing knife is formed in two portions 6*a* and 6*b* that depend from flange 2B are positioned laterally on opposite sides of the spout's entry orifice to passage 4. Being formed with a greater thickness of material and being relatively small in size, flanges 2B are relatively rigid and provide a stable platform for the knives. Flange 2B connects to the closure base along hinge 5 and also flexurally connects to diaphragm 3. The cross section of each of the knife sections is preferably triangular in shape. One apex of or point to each such triangle faces forward, that is, in the clockwise direction of rotation of spout 2, the direction that the spout pivots to reach the open upstanding position illustrated earlier in FIGS. 1 and 3. It should be realized that knife shapes other than triangular may be substituted for other embodiments and may be any shape or geometry that is sufficient to cut or puncture and spread the foil.

Continuing with FIG. 5, the bottom end of spout 2 contains a seal 8 that extends about the circular spout passage, as seen in this view parallel to the spout axis, which lies perpendicular to the drawing sheet in this view. A seal wall 10 depends from the bottom of the upper surface of the closure body. That seal wall is fortified or buttressed by the laterally extending reinforcing ribs 14 that extend along the body in a direction perpendicular to the seal wall.

Figure 4:
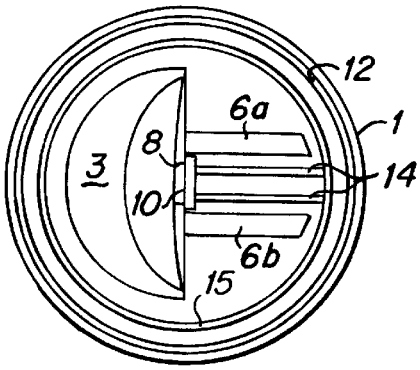
FIG. 4 is a bottom plan view of the dispensing closure in the condition presented in FIG. 2.

Reference is made to the bottom view of the closed spout presented in FIG. 4. As is apparent, spout 2, obstructed from view, lies along a radius of the circular shaped body 1 extending to the left on the upper side, and, at best, the only spout portion visible in the figure is the spout seal 8 at the spout's bottom end. The spout seal 8 abuts and seals against seal wall 10, the reinforcing ribs 14 ensuring that the seal wall remains rigid and in place.

Knives 6*a* and 6*b* are pivoted up in position and reside within the hollow region of the body's underside, concealed from view. The knives are formed of elongate members that are integrally attached to the spout's flange 2B, the length of the members being limited by the cylindrical side wall of body 1 so as to fit there within. The arrangement of the foregoing elements in the closed position is also illustrated in FIG. 6 to which reference is made.

As supplied to the bottler, the closure is in the closed position as was illustrated in FIGS. 2 and 4. Typically, the bottler fills the bottle with the dispensible ingredients, such as a beverage or other more viscous fluid or granular material, whatever the case may be, and seals the bottle with a metal foil covering, adhesively attached. Then the closure is screwed into place onto the neck of the bottle, which is the position of the closure illustrated in the partial section view of FIG. 6.

Figure 6:
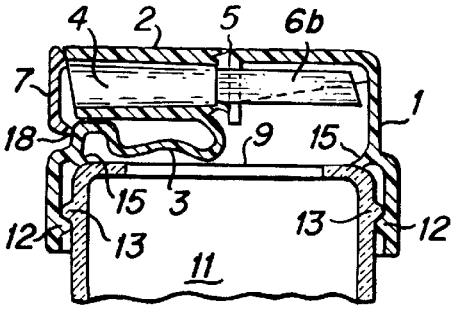
FIG. 6 is a partial section view of the dispensing closure in the closed condition in which it appears in FIGS. 2 and 4 and of the neck of a bottle to which the closure is attached in use.

As shown in FIG. 6, with the spout in the closed position and latched, the distal or orifice end of spout passage 4 is blocked by tear strip 7. Being blocked, the distal end of the spout thus cannot be gripped or pushed up with ones fingers. Tear strip 7 contains several small discrete sections or protrusions 18 on one side that are frangible and that join the tear strip integrally to body 1. The construction of tear strip 7 is such that should one seek to tamper with the closure by bending the strip over, instead of tearing it off, the strip will bend, essentially permanently, and it cannot be returned to its upright position even with that person's assistance. That activity leaves visible evidence of tampering.

With the closure screwed into place on the neck of the threaded bottle 11, as indicated by the engagement between the bottle's outer screw threads 13 and the internal screw threads 12 formed in closure body 1, the closure's cap seal 15 presses against the bottle's upper end rim or lip to seal the two components together so as to prevent leakage. The end of the bottle is covered with foil seal 9, suitably adhesively attached to the bottle. The closure's diaphragm 3, though folded, is sufficiently small in size and designed so that it does not press against or stress that foil seal.

To dispense confined ingredients from bottle 11, one must first remove tamper evident strip 7, which is next considered in greater detail. First, reference is again made to FIG. 1. It is seen that the closure body 1 in this embodiment contains an upper surface that is essentially flat or planar over a wide area and contains a semi-circular region or compartment recessed from that surface to the left of pivot 5 bordered by an internal cylindrical wall. That recess, and the internal cylindrical deepens as one progresses to the left. The outer periphery of diaphragm 3 is attached to that internal cylindrical wall and the diaphragm essentially serves as the bottom surface to that recessed region. Further a radially extending passage extends from that recessed region and opens along the outer cylindrical wall of the closure body. The radially extending passage is just wide enough to receive the spout. The length of the spout between the spout's lower end and its distal end is essentially equal to the distance between pivot 5 and the outer cylindrical wall of the closure body.

As shown in FIG. 2, when closed, spout 2 lies in that recessed region or compartment, preferably with its outer surface flush with the upper surface of the closure body and its distal end essentially flush with the outer cylindrical wall of the closure body. When closed, spout 2 occupies a great part of the recessed region, leaving only a small portion of the recessed region accessible on the right and left sides. That small remaining space is insufficient to permit a person's fingers to grip the sides of the spout and raise it. The accessible space to either side of spout 2 is quite limited, and is smaller in width than a persons finger tips. Hence, when closed, a casual tamperer should be unable to grip the sides of spout 2, and so cannot in that way raise the spout.

In order to raise the spout, the person must push upon the spout's orifice end 4. However, access to the orifice end of spout 2 is blocked by tamper evident tear strip 7. Hence, the person must first tear off tamper evident strip 7, typically pulling one of the free ends away from the closure, while holding the bottle attached to the closure. Absence of strip 7 is evidence that the closure may have been opened. Further, as generally indicated at 19 in FIG. 3, once the strip 7 is torn off the body, a roughened surface remains behind on the body where the strip was attached as further evidence of a previous access to the bottle's contents.

With strip 7 removed, the user pushes up on the distal end of spout 2, pivoting the spout upward, and rotating it clockwise (or, if viewed from the opposite side of the closure, counter-clockwise). The underside of the spout also rotates clockwise (or, as viewed from the opposite side, counter-clockwise), moving seal 8 away from seal wall 10, earlier viewed in FIGS. 4 and 5 to open the passage into spout 2, and simultaneously also swings the pointed corner of knives 6*a* and 6*b* down against the foil covering 9.

Figure 7:
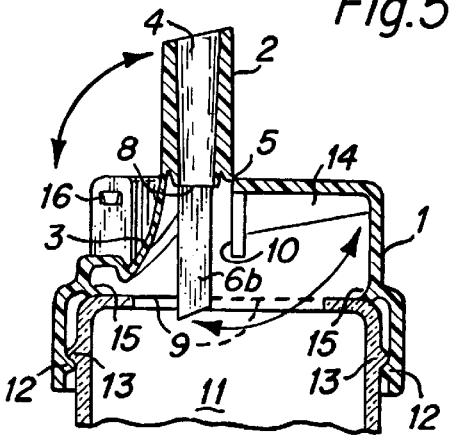
FIG. 7 is another partial section view of the dispensing closure in the open condition in which it appears in FIGS. 3 and 5 and of the neck of a bottle to which the closure is attached in use.

As shown by the curved dash line in the partial section view of FIG. 7, to which reference is made, the path of the knife's pointed corner carries the pointed corner into contact with the foil, represented by the horizontal dash line extending across the bottle's end. The rotating force exerted by the purchaser to open the spout is sufficient to enable the knives 6*a* and 6*b* to pierce the foil. And, as rotation continues, the edge of the knives slice through the metal foil.

As one appreciates from the drawings, the length of the knives are limited by the distance between the spout axis and the outer wall bordering the hollow region in the underside of body 1, but is sufficiently great in length to exceed the perpendicular distance between the underside of the upper surface of body 1 and the bottle's foil seal 9, thereby permitting the knives to protrude below the foil seal when the spout is in the upstanding or open position illustrated in FIG. 7. With the bottle seal broken, the bottle's contents may then be dispensed through passage 4 in spout 2.

In the preferred embodiment, the closure contains a conventional releasable spout latch. The spout is thereby latched into place, when manually moved into the horizontal closed position. The latch makes it even more difficult to lift the spout without first removing tamper evident strip 7, while ensuring the closure remains tightly sealed closed. Returning to FIG. 3, a pair axially extending ribs or splines 17 are formed on diametrically opposite sides of the spout to define one portion of the releasible snap latch. A pair of protrusions or barbs 16 are formed on the opposed side walls to the U-shaped opening or radial extending passage in the side wall that opens into of the well or recessed region in the closure and defines the remaining portion of the releasible spout latch.

The splines extend to within a predetermined distance of the spout's distal end and are of sufficient length to engage the associated latch members, barbs 16, when the spout is pivoted down to the closed position illustrated in FIG. 2. As is conventional, the upper surface of each barb 16 is tapered downward for a short vertical distance, forming a cam surface, and then drops off horizontally. The radially outward surface of splines 17 on the spout are spaced apart horizontally a greater distance that the distance between the sloped portions of those barbs, but are spaced about the same distance as the ends of the horizontal portion of those barbs located at the supporting walls.

To latch spout 2 closed, the user presses down on the spout to force the spout into its closed and latched position. In being pivoted down for closing, splines 17 encounter the cam or sloped surface of barbs 16, which initially provides an obstruction. The downward force exerted by the user must be sufficient to outwardly flex the side walls of the U-shaped cap portion 10 supporting barbs 16, and/or, through the splines, inwardly resiliently compress the spout, in order to move the spout down past the horizontal portion of barbs 16 and latch it in place. Once splines 17 have moved past the tapered portion of the barbs, the flexed surfaces elastically return to their original shape, "snap" back, and the barbs overlie the splines. Splines 17 catch and are held by the horizontally oriented surface of barbs 16, which now hold the spout down against any upward force that may be exerted by resiliency in diaphragm 3. Finger pressure exerted upwardly against the orifice end of the spout is sufficient to release that latch, and allow the spout to be pivoted to its open position.

The closure is formed in one piece by molding, forming a one-piece integral assembly defining the closure elements and the additional features. The '968 Dark patent describes the molding procedure for the one-piece closure presented in the patent (and marketed by the Allied Mold & Die company, of Fontana, Calif.) which is similar in structure to the present closure. For molding of the preferred embodiment, the mold comprises two steel mold parts that mate together to define the structure being molded, like that described in the '968 Dark patent, with an additional slide or side action. The small frangible connections (protrusions 18) attaching the tamper evident strip 7 to the closure creates an under-cut in the cavity of the mold. For the closure to be removed from the cavity, a slide action is required in the cavity to move the under-cut out of the way before the part can be removed from the cavity and ejected from the mold. Given the described closure, such mold requirements and design are well understood by those skilled in molding of plastic parts.

For a practical embodiment the preferred plastic material preferred is a co-polymer polypropylene, more specifically a rubber modified co-polymer. Polypropylene is a member of the Polyolefin family, many of which can be used for the disclosed closures. The properties of polypropylene are such that thick sections are relatively rigid, thinner sections are flexible and very thin sections can be used as living hinges. As those skilled in the art the invention may be molded from any of a variety of known plastic materials and as new plastic materials are developed in the future such new materials may also be used for the disclosed closure.

In the foregoing embodiment, the invention was illustrated as part of a barrier piercing dispensing closure that is molded into a unitary one-piece integral assembly of the closure components. However the closure is not required to be of the one piece structure. As those skilled in the art appreciate from reading the foregoing description, in other less preferred embodiments, the barrier piercing assembly may alternatively be incorporated as part of dispensing closures that are assembled together from two or more separate elements.

Further, although dispensing closures have been described in connection with a beverage bottle, as those skilled in the art appreciate such closures may be applied to dispensing of any flowable materials ordinarily dispensed by closures in general, whether fluid, granular material or the like. Lotions, conditions, detergents, soaps, toothpaste, honey, salt, pepper and other seasonings are additional examples of the materials that may be dispensed.

It is believed that the foregoing description of the preferred embodiments of the invention is sufficient in detail to enable one skilled in the art to make and use the invention. However, it is expressly understood that the detail of the elements presented for the foregoing purpose is not intended to limit the scope of the invention, in as much as equivalents to those elements and other modifications thereof, all of which come within the scope of the invention, will become apparent to those skilled in the art upon reading this specification. Thus the invention is to be broadly construed within the full scope of the appended claims.

What is claimed is:

1. A dispensing closure for a foil covered container comprising:

a base, said base supporting a spout and diaphragm, said spout being coupled to said diaphragm and pivotally mounted to said base for pivotal movement between an open position oriented upright on the upperside of said base and a closed position oriented alongside said upperside of said base;

said base including an upper side and an underside;

said spout extending through said base, said spout including a dispensing end, and an entry end and a passage between said ends extending through said base from said upperside to said underside of said base;

a barrier supported on said underside of said base;

said barrier for closing said entry end of said spout passage when said spout is in said closed position to close said passage and prevent fluid passage through said spout;

a frictional latch for retaining said spout in said closed position, said frictional latch located at an outer end of said spout;

said base including a recess for receiving said spout when said spout is in said closed position to prevent said spout from being gripped from the side, said recess being bounded at least in part by said diaphragm;

a frangible strip extending upwardly from a side of said base in front of an open end to said recess, said frangible strip being adjacent to and confronting said dispensing end of said spout to block access to said dispensing end when said spout is in the closed position, said frangible strip being detachable from said base to permit access to said dispensing end for pivoting said spout to the open position;

foil piercing means, said foil piercing means being mounted for pivotal movement with said spout, wherein pivotal movement of said spout from said closed position to said open position, concurrently pivots said piercing means from a position alongside said underside surface of said base to a down standing position, extending away from said base;

said foil piercing means including:

a first and second elongate knife members, said first and second members mounted in spaced relation to each side of said entry end of said spout and extending in parallel, said elongate knife member each containing a pointed end and being of a length greater than the height of said base, whereby said knife members may contact and pierce said foil covering as said knife members are pivoted by said spout to said down standing position; and said base, spout, diaphragm, barrier, frangible strip, latch, and foil piercing means being formed as a unitary one-piece assembly.

2. A dispensing closure for attachment to a foil covered end of a container, said dispensing closure comprising:

a base;

a spout pivotally mounted to said base, said spout being pivoted between a closed position and an open position; and a foil piercing device;

said foil piercing device being coupled to said spout for pivotal movement therewith, wherein pivotal movement of said spout to the open position pivots said foil piercing device into contact with the foil covered container end to pierce said foil.

3. The invention as defined in claim 2, wherein said dispensing closure comprises a unitary assembly formed in one piece of plastic material.

4. The invention as defined in claim 2, wherein said foil piercing device comprises:

first and second elongate members, each said member having a cross-section defining a triangle, said member having a pointed corner and a linear edge extending through said corner.

5. The invention as defined in claim 4 wherein said elongate members being positioned with said pointed corner facing said foil covered end of said bottle, whereby said pointed corner punctures said foil when said members are pivoted clockwise.

6. The invention as defined in claim 2, wherein said spout includes a central passage, and a rigid flange, said rigid flange extending to either side of said spout passage, whereby said rigid flange pivots with pivoting of said spout;

wherein said foil piercing device comprises:

first and second elongate members, each said member having a cross-section defining a triangle, said member having a pointed corner and a linear edge extending through said corner;

said first elongate member having an end attached to said rigid flange at a position thereon to one side of said spout and said second elongate member having an end attached to said rigid flange at a position thereon to an opposite side of said spout, whereby said first and second elongate members are coupled to said spout for pivotal movement with said spout;

said first and second elongate members being positioned with said respective pointed corner facing said foil covered end of said bottle, whereby said pointed corner punctures said foil when said members are pivoted clockwise.

7. The invention as defined in claim 6, wherein said dispensing closure comprises a unitary assembly formed in one piece of plastic material.

8. A dispensing closure for a container, said container having a dispensing end, and a barrier sealing said dispensing end, comprising:

a closure body;

a re-sealable manually operated dispenser carried in said closure body;

said manually operated dispenser having a closed position and an open position, said open position defining an exit passage for release of materials from said container through said closure body when said barrier is penetrated, and said closed position for closing said exit passage, said dispenser being manually operated from said closed position to said open position and vice-versa; and a barrier cutter for penetrating said barrier; said barrier cutter for penetrating said barrier, responsive to said dispenser being operated to said open position.

9. The invention as defined in claim 8, wherein said manually operated dispenser is movable between said open and closed positions, and wherein said barrier cutter is mechanically coupled to said manually operated dispenser for joint movement therewith.

10. The invention as defined in claim 9, wherein said manually operated dispenser comprises a spout, said spout being pivotally mounted for pivotal movement; and wherein said barrier cutter comprises an elongate member containing a pointed distal end edge, whereby pivotal movement of said spout from said closed position to said open position produces pivotal movement of said pointed distal end edge into said barrier to perforate said barrier.

11. The invention as defined in claim 10, wherein said barrier comprises a metal foil.

12. A dispensing closure for a container, said container having a dispensing end, and a barrier sealing said dispensing end, comprising:

a closure body;

a re-sealable manually operated dispenser carried in said closure body;

said manually operated dispenser having a closed position and an open position, said open position defining an exit passage for release of materials from said container through said closure body when said barrier is penetrated, and said closed position for closing said exit passage, said dispenser being manually operated from said closed position to said open position and vice-versa; and a barrier cutter for penetrating said barrier; and wherein said dispenser, said closure body and said barrier cutter are integrally formed as a unitary one piece assembly of plastic material.

13. The invention as defined in claim 12, further comprising: a tamper evident tear-off strip to block operation of said manually operated dispenser, said tamper evident strip being carried on said closure body.

14. The invention as defined in claim 10, further comprising: a tamper evident tear-off strip to block operation of said manually operated dispenser, said tamper evident strip being carried on said closure body.

15. The invention as defined in claim 14, wherein said closure further includes a latch for releasably latching said dispenser in said closed position.

16. A dispensing closure for a container, said container having a dispensing end, and a barrier sealing said dispensing end, comprising:

a closure body;

a re-sealable manually operated dispenser carried in said closure body;

said manually operated dispenser having a closed position and an open position, said open position defining an exit passage for release of materials from said container through said closure body when said barrier is penetrated, and said closed position for closing said exit passage, said dispenser being manually operated from said closed position to said open position and vice-versa;

a barrier cutter for penetrating said barrier;

a latch for releasably latching said spout in said closed position; and wherein said dispenser, said closure body, said latch and said barrier cutter are integrally formed as a unitary one piece assembly of plastic material.

* * * * *